United States Patent [19]

Shirakuma et al.

[11] 4,432,698

[45] Feb. 21, 1984

[54] COMPRESSOR HAVING A STARTING LOAD REDUCING APPARATUS

[75] Inventors: Takashi Shirakuma; Fujio Nakamichi; Osamu Iguchi, all of Yokohama, Japan

[73] Assignee: Tokico, Ltd., Kawasaki, Japan

[21] Appl. No.: 317,871

[22] Filed: Nov. 3, 1981

[30] Foreign Application Priority Data

Nov. 4, 1980 [JP] Japan ..... 55-157775[U]

[51] Int. Cl.[3] ..... F04B 49/06

[52] U.S. Cl. ..... 417/27; 417/29; 417/290; 417/298

[58] Field of Search ..... 417/38, 290, 292, 298, 417/299, 27, 29

[56] References Cited

U.S. PATENT DOCUMENTS

| | | | |
|---|---|---|---|
| 2,256,565 | 9/1941 | Mantle | 417/298 |
| 2,681,177 | 6/1954 | Hartwell | 417/298 |
| 2,730,296 | 1/1956 | Hartwell | 417/298 |
| 3,486,080 | 12/1969 | Tillmann | 361/165 |
| 3,490,683 | 1/1970 | Kocher | 417/503 |
| 3,794,789 | 2/1974 | Bynum | 417/38 |
| 4,234,904 | 11/1980 | Fahlesson | 361/165 |
| 4,320,309 | 3/1982 | Griffiths et al. | 361/165 |

FOREIGN PATENT DOCUMENTS

| | | | |
|---|---|---|---|
| 5314206 | 7/1976 | Japan | 417/290 |
| 53-38445 | 10/1978 | Japan | 417/290 |

*Primary Examiner*—William L. Freeh
*Assistant Examiner*—Paul F. Neils
*Attorney, Agent, or Firm*—Andrus, Sceales, Starke & Sawall

[57] ABSTRACT

A compressor having a starting load reducing apparatus comprises a main compressor body for compressing gas obtained under suction from an intake chamber through an intake valve within a compression chamber, and ejecting the compressed gas through an outlet opening, a motor for driving the main compressor body, a switch for starting the motor by closing, a solenoid mechanism operated by the closing of the switch, for forcibly communicating the compression chamber with the intake chamber, to put the main compressor body into a non-compressing operational state, and a positive thermally sensitive resistor element connected at a stage before a coil of the solenoid mechanism. The solenoid mechanism operates after the switch is closed until the time when the resistance of the positive thermally sensitive resistor element reaches a predetermined resistance.

5 Claims, 9 Drawing Figures

COMPRESSOR HAVING A STARTING LOAD REDUCING APPARATUS

BACKGROUND OF THE INVENTION

The present invention generally relates to compressors, and more particularly to a compressor having a starting load reducing apparatus for automatically reducing operational load of a main compressor body which acts on a motor upon starting of the compressor.

Generally, an air compressor is operated when a main compressor body is driven by a motor. The characteristic of the motor is generally such that the torque is small upon starting of the motor. Hence, upon starting of the compressor, it is desirable for the load which is acting on the motor to be small. Thus, conventionally, there was a simple apparatus for reducing the load upon starting of the compressor. In this conventional apparatus, a manipulation knob which is manually manipulated from the outside, is provided on the main compressor body, and this manipulation knob is pushed and manipulated upon starting of the compressor to open a suction valve in the main compressor body. Therefore, in the above conventional apparatus, a compression chamber and an intake chamber are forcibly communicated, so that the main compressor body does not perform a compressing operation, that is, performs a non-compressing operation, upon starting of the compressor. In the compressor having the above described apparatus, the load acting with respect to the motor upon starting of the compressor, is accordingly reduced.

On the other hand, in order to reduce the electrical power consumption, a pressure switch is provided in an air tank of the air compressor, to stop the operation of the compressor when the pressure within the air tank exceeds a predetermined pressure. Moreover, when the pressure within the air tank becomes lower than a predetermined pressure, the compressor is again operated (re-started). In the compressor operated in this manner, in a case where the above manual type starting load reducing apparatus is used in order to reduce the load upon starting of the compressor, the above described manual manipulation must be performed every time the compressor starts another operation, before the starting of the operation or with a same timing as the starting of the operation. However, it is actually impossible to perform the above manual manipulation every time the compressor is started. Therefore, the manual type starting load reducing apparatus cannot be applied to the compressor operated in the above described manner.

Hence, in reality, the air compressor is constructed so that the main compressor body starts the compressing operation from the starting of the air compressor. Furthermore, a motor capable of generating a sufficiently large starting torque which exceeds the large load of the main compressor body, such as a single-phase capacitor-start type motor, is used for the small-size air compressor. However, this capacitor-start type of a motor is high in cost and large in size, and further, the electrical power consumption of this type of a motor is high. Therefore, there was a disadvantage in that the cost and the electrical power consumption of the compressor became high, to increase the operational cost of the compressor.

SUMMARY OF THE INVENTION

Accordingly, it is a general object of the present invention to provide a novel and useful compressor having a starting load reducing apparatus, in which the above described disadvantages have been overcome.

Another and more specific object of the present invention is to provide a compressor having a starting load reducing apparatus which is provided with a positive thermally sensitive resistor element (hereinafter referred to as a PTC (positive temperature coefficient thermistor) at the output side of a starting switch of the compressor, and a solenoid mechanism for forcibly communicating a compression chamber and an intake chamber of a main compressor body by the operation of the resistor element. According to the compressor of the present invention, the main compressor body is automatically put into a small-load state upon starting of the compressor, and the compressor can be started in a state where the load is reduced regardless of the operational mode of the compressor. Furthermore, a motor having a starting torque corresponding to the small load, and having low cost and electrical power consumption, can be used for the compressor.

Other objects and further features of the present invention will be apparent from the following detailed description when read in conjunction with the accompanying drawings.

DETAILED DESCRIPTION

Figure 1:
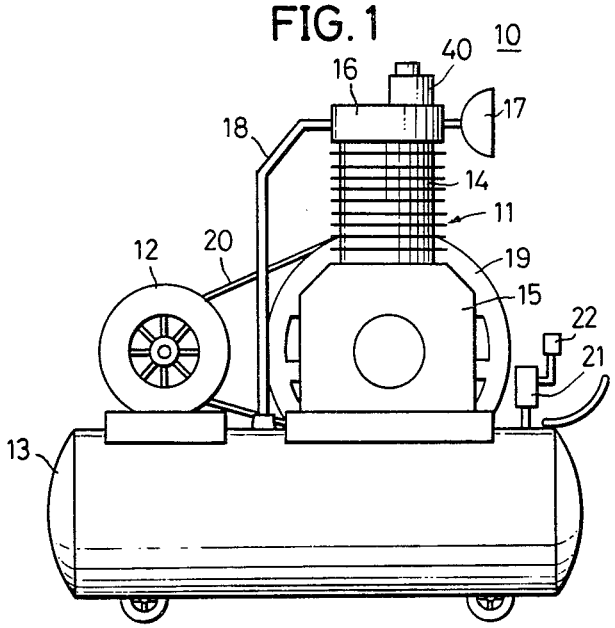
FIG. 1 is an elevation showing an embodiment of a compressor having a starting load reducing apparatus according to the present invention.

In FIG. 1, an air compressor 10 comprises a main compressor body 11 and a motor 12 which are provided above an air tank 13. The main compressor body 11 consists of a cylinder 14, a crank chamber 15, a cylinder head 16, an intake filter 17, an outlet pipe 18 communicating with the air tank 13, and the like. A belt 20 is provided between the motor 12 and a pulley 19 for driving a piston. A safety valve 21 and a pressure switch 22 are respectively provided within the air tank 13. The above pressure switch 22 opens when the pressure within the air tank 13 reaches a predetermined high pressure, and closes when the compressed air is consumed and the pressure within the air tank 13 becomes of a predetermined low pressure. As will be described hereinafter, the pressure switch 22 functions as a motor starting switch.

Figure 2:
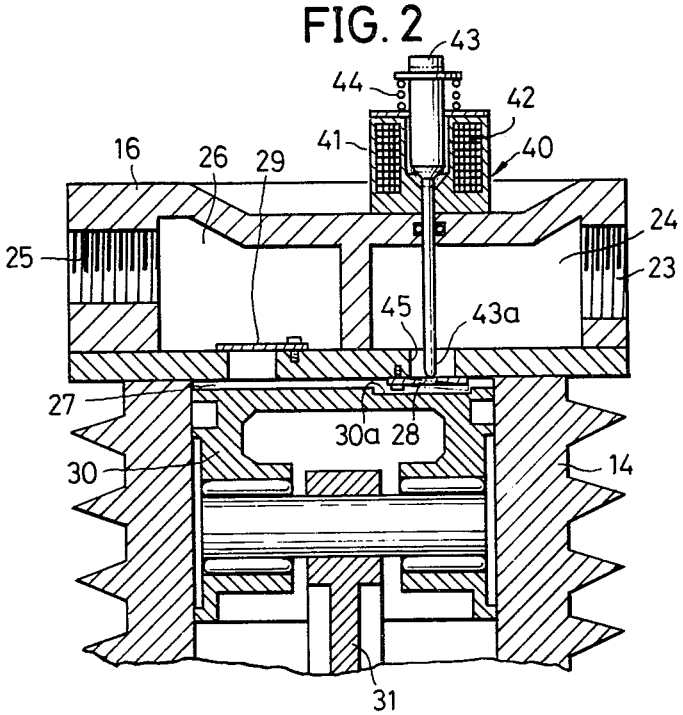
FIG. 2 is a diagram in cross section, showing an essential part of the compressor shown in FIG. 1 in an enlarged state.

The main compressor body 11 has a construction shown in FIG. 2. The cylinder head 16 has an intake 23 where the intake filter 17 is mounted, an intake chamber 24, an outlet 25 where the outlet pipe 18 is mounted, and an outlet chamber 26. An intake valve 28 is provided between the intake chamber 24 and a compression chamber 27 within the cylinder 14. On the other hand, an outlet valve 29 is provided between the outlet chamber 26 and the compression chamber 27. A piston 30 is provided within the cylinder 14. A depression 30*a* is formed in the vertex surface of the piston 30 at a part opposing the intake valve 28. This depression 30*a* is provided in order to permit the intake valve 28 to open. The piston 30 is connected to a crank (not shown) within the crank chamber 15, through a connecting shaft 31.

The pulley 19 is rotated by the motor 12, and the piston 30 undergoes a reciprocating movement. Accordingly, the air obtained under suction from the intake chamber 24 through the intake valve 28, is compressed within the compression chamber 27. The compressed air is then ejected into the outlet chamber 26 through the outlet valve 29, and stored within the air tank 13.

A DC solenoid mechanism 40 is provided at the cylinder head 16. This solenoid mechanism 40 consists of a coil 42 within a case 41, a plunger 43, and a compressed coil spring 44 which urges the plunger 43 in the upward direction. The above plunger 43 is moved downwards by an attractive force when the coil 42 is applied with a current and excited. The plunger 43 has a rod part 43*a* which projects within the cylinder head 16 and extend to a part in the vicinity of the suction valve 28. When the coil 42 is not applied with a current, the plunger 43 is at a raised position by the action of the spring 44. In this state, the tip end of the rod part 43*a* enters within an opening 45 for the intake valve, and opposes the intake valve 28 which is in the closed state. The above rod part 43*a* pushed the intake valve 28 upon lowering of the plunger 43 as will be described hereinafter, to open the intake valve 28 as indicated by a two-dot chain line in FIG. 2.

Figure 3:
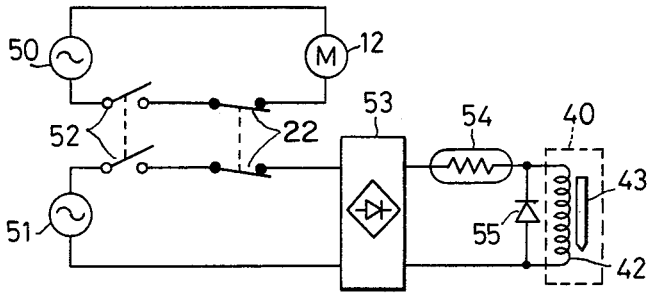
FIG. 3 is a circuit diagram showing an embodiment of an electrical circuit operating together with the compressor shown in FIG. 1.
Figure 4:
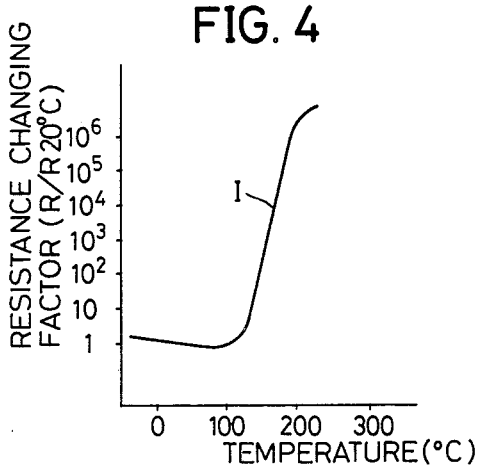
FIG. 4 is a graph showing an example of a relationship between temperature and resistance varying ratio in a PTC thermistor.

FIG. 3 shows an embodiment of an electrical circuit which operates together with the air compressor 10 shown in FIG. 1. This electrical circuit is of a type using two power sources. The motor 12 is operated by a first AC power source 50, while the solenoid mechanism 40 is operated by a second AC power source 51. A motor starting switch 52 which is manually operated and the above pressure switch 22 are connected in series, and provided between the first AC power source 50 and the motor 12, and also between the second AC power source 51 and the solenoid mechanism 40. In the circuit including the second AC power source 51, a rectifier 53 and a PTC thermistor 54 are connected as shown in FIG. 4. The PTC thermistor 54 is provided at the output side of the rectifier 53. For example, "POSISTER" (trademark) manufactured by Murata Manufacturing Co., Ltd., product number PTH60AR 750M2B101 or PTH4649, can be used for the above PTC thermistor 54. As indicated by a line I shown in FIG. 4, the PTC thermistor 54 has a characteristic in which the resistance increases as the temperature rises. Moreover, a diode 55 is connected in parallel with respect to the coil 42, in order to eliminate the counterelectromotive voltage introduced when the switch is opened.

Next, description will be given with respect to the operation of the air compressor 10, especially with respect to the operation upon starting of the air compressor 10, by referring to FIG. 5.

When the air compressor 10 is started, the pressure within the air tank 13 is normally below the above described low predetermined pressure. The pressure switch 22 is closed, and the PTC thermistor 54 is of a low resistance at room temperature. The motor 12 is started when the motor starting switch 52 is actuated, and in addition, a DC current which is rectified at the rectifier 53 is supplied to the coil 42 through the PTC thermistor 54. This rectified DC current is supplied to the solenoid mechanism 40 to excite the solenoid mechanism 40.

The plunger 43 is attracted and moves downwards against the spring 44 when the solenoid mechanism 40 is operated. Hence, the downwardly moving plunger 43 pushes the intake valve 28 and forcibly opens the intake valve 28 as indicated by the two-dot chain line in FIG. 2. Since the intake valve 28 is accordingly opened, the compression chamber 27 becomes communicated with the intake chamber 24, and the air compressor 10 becomes substantially open to the atmosphere. Therefore, the main compressor body 11 is thus substantially put into a no-load operational state (non-compressing state) in which the main compressor body 11 does not perform a compressing operation even when the piston 30 moves upwards.

Accordingly, the load applied to the motor 12 upon starting of the motor 12 can be reduced considerably. Hence, the motor 12 starts to rotate against the reduced load, and the rotational speed of the motor 12 is gradually increased.

Figure 5:
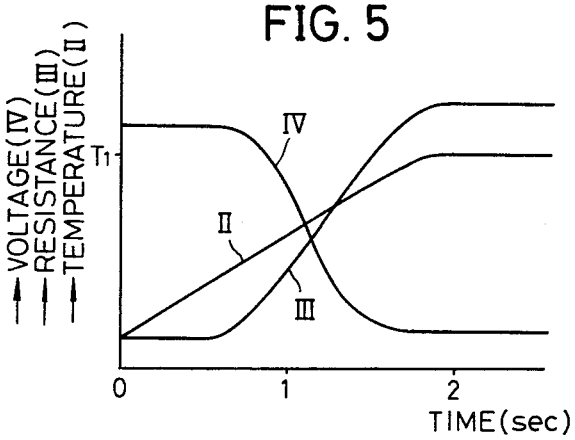
FIG. 5 is a graph showing varying states of temperature and resistance value of the PTC thermistor with respect to time upon starting of the compressor, and varying state of voltage applied to a solenoid mechanism with respect to time upon starting of the compressor.

The temperature of the above PTC thermistor 54 rises as indicated by a line II in FIG. 5 wherein the vertical axis indicates the temperature, with lapse of time after current is applied to the PTC thermistor 54. Accompanied by the rise in temperature of the PTC thermistor 54, the internal resistance of the PTC thermistor 54 increases as indicated by a line III in FIG. 5 wherein the vertical axis indicates the resistance. As the resistance of the PTC thermistor 54 increases, the voltage applied to the coil 42 decreases as indicated by a line IV in FIG. 5 wherein the vertical axis indicates the voltage (for example, the voltage applied to the coil 42 is approximately 80 volts when the motor starting switch 52 is actuated, approximately fifty volts after lapse of one second, and substantially zero after lapse of two seconds). Thus, the attractive force exerted with respect to the plunger 43 decreases, and the plunger 43 is finally returned upwards by the resilient force exerted by the compressed coil spring 44 and is held in its returned state. When the plunger 43 is returned upwards to the original position, the intake valve 28 becomes closed. Moreover, the main compressor body 11 starts a compressing operation, to put the air compressor 10 into an operational state under load. That is, the air compressor 10 is put into the above operational state under load, after a predetermined time delay from the time the motor starting switch 52 is actuated.

By the time the air compressor 10 reaches the above operational state under load, the rotational speed of the motor 12 is already increased to the rated rotational speed. Hence, the rotational torque of the motor 12 sufficiently exceeds the compressing operation load exerted against the main compressor body 11. Accordingly, the state of the air compressor 10 is smoothly changed from the substantially no-load operational state to the operational state under load.

In addition, the resistance of the PTC thermistor 54 increases as the temperature rises, and the current flowing through the PTC thermistor 54 accordingly decreases. However, in a final state, the electrical energy applied to the PTC thermistor 54 and the thermal radiation quantity radiated from the PTC thermistor 54 are balanced, and the PTC thermistor 54 stabilizes at a constant temperature T1 and remains at a higher resistance state. Therefore, the plunger 43 remains at the raised and returned state, and the air compressor 10 continues the operation under load.

Furthermore, the time required from the time the motor starting switch 52 is actuated until the time the air compressor 10 changes state to the operational state under load, is set to approximately two seconds, for example, by considering the starting characteristic and the like of the motor 12.

When the air compressor 10 continues the operation and the pressure within the air tank 13 reaches the predetermined high pressure, the pressure switch 22 opens to stop the operation of the air compressor 10 by stopping the rotation of the motor 12. Moreover, the current supplied to the PTC thermistor 54 is interrupted due to the opening of the pressure switch 22. Hence, the temperature of the PTC thermistor 54 decreases to room temperature, that is, to the state before the motor starting switch 52 is actuated.

When the pressure within the air tank 13 decreases to the above predetermined low pressure after the compressed air within the air tank 13 is consumed, the pressure switch 22 closes to re-start the motor 12. In this case, similarly as in the above described case wherein the air compressor 10 was first started, the solenoid mechanism 40 is operated simultaneously as when the pressure switch 22 is closed. Thus, the air compressor 10 is automatically put into the state where the load is reduced, and operated again in this state. After lapse of the predetermined time, the operational state of the air compressor 10 is changed to the operational state under load.

Therefore, the operational state of the air compressor 10 is automatically changed to the state wherein the load is reduced, when the air compressor 10 is first started and the air compressor 10 is afterwards restarted. A motor having a small starting torque such as a capacitor-run type motor can be used for the above motor 12. This capacitor-run type motor is low in cost and small in size compared to the capacitor-start type motor which was conventionally required, and moreover, the electrical power consumption of the capacitor-run type motor is small.

Figure 6:
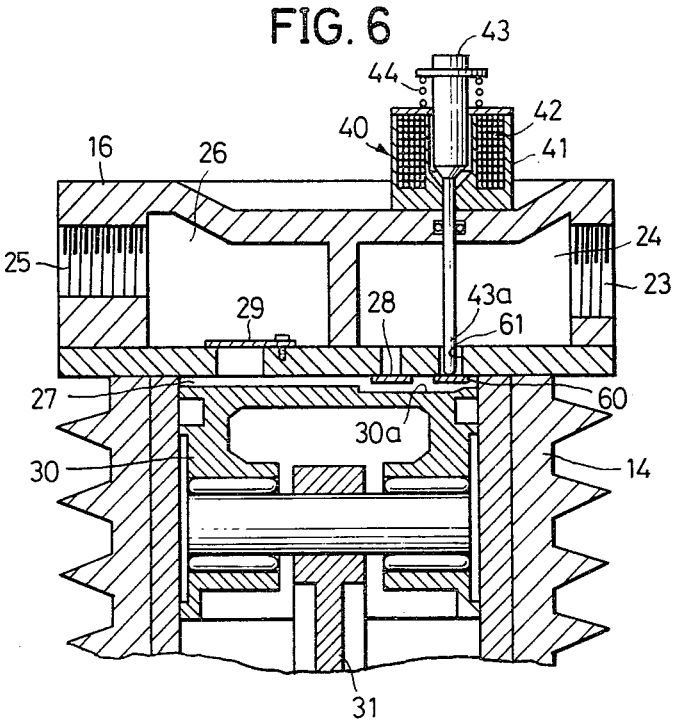
FIG. 6 is a diagram showing a modification of a cylinder head part in the essential part of the compressor shown in FIG. 2.

FIG. 6 shows a modification of a cylinder head part of the above air compressor 10. In FIG. 6, those parts which are the same as those corresponding parts in FIG. 2 are designated by like reference numerals, and their description will be omitted.

In FIG. 6, an unloading valve 60 is provided beside the intake valve 28, and the rod part 43*a* of the plunger 43 projects within an airhole 61 to oppose the unloading valve 60. When the solenoid mechanism 40 is operated, the unloading valve 60 is pushed downwards and opened. Hence, the compression chamber 27 and the intake chamber 24 are communicated through the airhole 61, and the air compressor 10 is put into the substantially no-load operational state.

Figure 7:
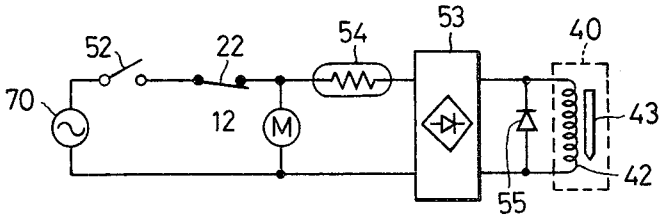
FIG. 7 is a circuit diagram showing another embodiment of an electrical circuit operating together with the compressor shown in FIG. 1.

FIG. 7 shows another embodiment of an electrical circuit which operates together with the air compressor 10. In FIG. 7, those parts which are the same as those corresponding parts in FIG. 3 are designated by like reference numerals, and their description will be omitted. The electrical circuit shown in FIG. 7 is constructed to operate the motor 12 and the solenoid mechanism 40 by a same AC power source 70. Furthermore, in this electrical circuit, the PTC thermistor 54 is connected on the side of the AC power source 70, that is, so that the rectifier 53 is connected in a parallel manner between the PTC thermistor 54 and the solenoid mechansim 40 as shown in FIG. 7. Since the PTC thermistor 54 is provided at a stage before the rectifier 53, the PTC thermistor 54 also acts to absorb the noise component introduced from the AC power source 70. Accordingly, the diode which constructs the rectifier 53 is protected from the above noise component. The PTC thermistor 54 operates in a manner similar to the case shown in FIG. 3 in which the PTC thermistor 54 is connected between the rectifier 53 and the solenoid mechanism 40 in a series manner. In addition, since the PTC thermistor 54 is connected in the manner shown in FIG. 7, the characteristic of the electrical circuit is not easily degraded.

Moreover, capacitors for absorbing noise, can be provided in the electrical circuits shown in FIGS. 3 and 7.

Figure 8:
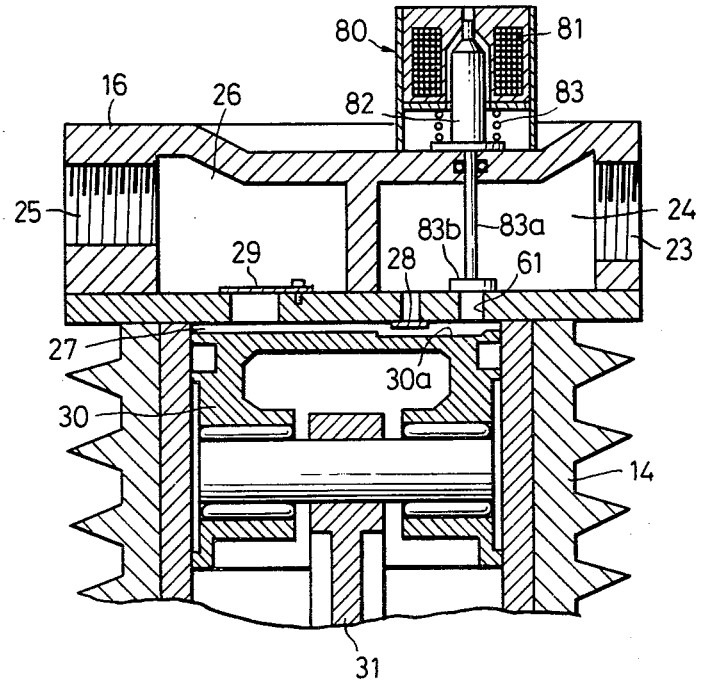
FIG. 8 is a diagram showing another modification of a cylinder head part of the compressor shown in FIG. 2.

FIG. 8 shows another modification of a cylinder head part of the above compressor 10. In FIG. 8, those parts which are essentially the same as those corresponding parts in FIG. 6 are designated by like reference numrals, and their description will be omitted.

A solenoid mechanism 80 is constructed so that a plunger 82 is moved upwards when a coil 81 is excited. Normally, the plunger 82 is moved downwards by a force exerted by a compressed coil spring 83, and a valve part 83*b* at the tip end of a rod part 83 closes the airhole 61. When the solenoid mechanism 80 is operated, the valve part 83*b* moves upwards to open the upper part of the airhole 61. Accordingly, the compression chamber 27 is thus communicated with the intake chamber 24 through the airhole 61.

Next, description will be given with respect to the relationship between the operational load of the compressor upon starting of the compressor in the above embodiment of the invention and the torque characteristic of a capacitor-run motor, by referring to FIG. 9.

Figure 9:
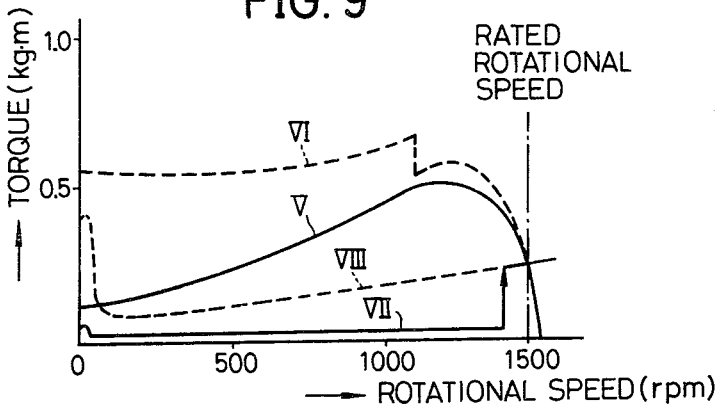
FIG. 9 is a graph showing a relationship between operational load of the main compressor body and torque of the motor upon starting the compressor.

In FIG. 9, a line V indicates the torque characteristic of the capacitor-run type motor 12, and a line VI indicates the operational characteristic of a capacitor-start type motor. In addition, a line VII indicates the operational load characteristic of the main compressor body 11 which is started at a state where the load is reduced, and a line VIII indicates the operational load characteristic of the main compressor body 11 in a case where the operation is started by initially starting the compressing operation.

As clearly seen from each line in FIG. 9, the torque of the capacitor-run type motor 12 upon starting is smaller than the starting torque of the capacitor-start type motor. However, the above torque of the motor 12 upon starting exceeds the load upon starting of the main compressor body 11 in the state where the load is reduced.

Therefore, the main compressor body 11 is started by the capacitor-run type motor 12 without introducing inconveniences, and the compressor 10 is started in a normal manner.

The starting load reducing apparatus which constitutes the essential part of the present invention can also be applied to a type of compressor in which the air tank 13 is not provided and the pressure switch 22 is accordingly omitted. On the other hand, the above starting load reducing apparatus can also be applied to a type of compressor in which the motor starting switch 52 is not provided and only the pressure switch 22 is provided. In addition, the starting load reducing apparatus which constitutes the essential part of the present invention is not limited to the application with respect to the above reciprocating type compressor, and can be applied to a vane type compressor, for example.

Furthermore, the present invention can be also applied to a so-called built-in type compressor in which a motor shaft is directly connected to a connecting rod so that the main compressor body and the motor assume a unitary structure.

Further, the present invention is not limited to these embodiments, but various variations and modifications may be made without departing from the scope of the present invention.

What is claimed is:

1. A compressor having a starting load reducing apparatus comprising:

a main compressor body for compressing gas obtained under suction from an intake chamber through an intake valve within a compression chamber, and ejecting the compressed gas through an outlet opening;

a motor for driving said main compressor body;

first and second switches for starting said motor when both said first and second switches are closed;

a solenoid mechanism operated when both said first and second switches are closed, for forcibly communicating said compression chamber with said intake chamber, to put said main compressor body into a non-compressing operational state;

a rectifier provided at a stage before a coil of said solenoid mechanism; and a positive thermally sensitive resistor element provided at a stage before said rectifier, said solenoid mechanism operating after both said first and second switches are closed until a time when the resistance of said positive thermally sensitive resistor element reaches a predetermined resistance.

2. A compressor as claimed in claim 1 in which said solenoid mechanism consists of said coil, a plunger attracted when current is applied to said coil, an intake valve pushed and opened by said plunger when said plunger is attracted, and a spring for pushing back said plunger.

3. A compressor as claimed in claim 1 in which said solenoid mechanism consists of said coil, a plunger attracted when current is applied to said coil, and an unloading valve pushed and opened by said plunger when said plunger is attracted, and said unloading valve is provided separately with respect to said intake valve.

4. A compressor as claimed in claim 1 in which said first switch is a motor starting switch which is operated manually upon starting of said compressor.

5. A compressor as claimed in claim 4 further comprising a tank for storing compressed gas obtained from said main compressor body, in which compressor said second switch is a pressure switch coupled in series with said motor starting switch, said pressure switch being provided within said tank, said pressure switch opening when the pressure within said tank reaches a predetermined high pressure and closing when the pressure within said tank decreases to a predetermined low pressure.

* * * * *